US010765175B2

(12) United States Patent
Panian et al.

(10) Patent No.: US 10,765,175 B2
(45) **Date of Patent: *Sep. 8, 2020**

(54) ARTICLE WITH ADJUSTABLE REARWARD COVERING PORTION

(71) Applicant: NIKE, Inc., Beaverton, OR (US)

(72) Inventors: Nadia M. Panian, Beaverton, OR (US); Thomas J. Rushbrook, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 399 days.

This patent is subject to a terminal disclaimer.

(21) Appl. No.: 15/259,745

(22) Filed: Sep. 8, 2016

(65) Prior Publication Data

US 2016/0374433 A1 Dec. 29, 2016

Related U.S. Application Data

(63) Continuation of application No. 13/913,632, filed on Jun. 10, 2013, now Pat. No. 9,474,330.

(51) Int. Cl.

| | |
|---|---|
| ***A43C 1/00*** | (2006.01) |
| ***A43C 11/16*** | (2006.01) |
| ***A43B 11/00*** | (2006.01) |
| ***A43B 23/02*** | (2006.01) |
| ***A43B 3/00*** | (2006.01) |
| ***A43B 13/12*** | (2006.01) |
| ***A43C 11/14*** | (2006.01) |

(52) U.S. Cl.

CPC ..... *A43C 11/165* (2013.01); *A43B 3/0005* (2013.01); *A43B 11/00* (2013.01); *A43B 13/125* (2013.01); *A43B 23/0295* (2013.01); *A43C 1/00* (2013.01); *A43C 1/006* (2013.01); *A43C 11/14* (2013.01)

(58) Field of Classification Search

CPC ..... A43B 3/242; A43B 13/125; A43B 3/0005; A43B 23/0295; A43B 11/00; A43C 11/165; A43C 11/14; A43C 1/006; A43C 1/00

See application file for complete search history.

(56) References Cited

U.S. PATENT DOCUMENTS

| | | | |
|---|---|---|---|
| 1,114,435 | A | 10/1914 | Batten |
| 1,184,123 | A | 5/1916 | Paul |
| 2,420,239 | A | 5/1947 | Hack |
| 2,483,525 | A | 10/1949 | Brust |
| 2,487,227 | A | 11/1949 | Eberle |

(Continued)

FOREIGN PATENT DOCUMENTS

JP 2006-000429 A 1/2006

*Primary Examiner* — Katharine Gracz

(74) *Attorney, Agent, or Firm* — Banner & Witcoff, Ltd.

(57) ABSTRACT

An article of footwear includes an upper with a forward covering portion and a rearward covering portion. The rearward covering portion can be adjusted between an open configuration for receiving a foot and a closed configuration for covering the foot. In the open configuration the rearward covering portion is approximately flat, while in the closed configuration the rearward covering portion has a three-dimensional shape. The rearward covering portion may be folded vertically between the open configuration and the closed configuration. A tensioning member can be used to control the configuration of the rearward covering portion.

20 Claims, 15 Drawing Sheets

(56) References Cited

U.S. PATENT DOCUMENTS

| | | | | |
|---|---|---|---|---|
| 2,619,744 | A | 12/1952 | Mattes | |
| 2,806,300 | A | 9/1957 | Morgan, Jr. | |
| 2,926,434 | A | 3/1960 | Morgan | |
| 2,994,972 | A | 8/1961 | Blair | |
| 3,057,086 | A | 10/1962 | Rigsby | |
| 3,192,651 | A | 7/1965 | Smith | |
| 3,681,860 | A | 8/1972 | Bidegain | |
| 3,762,075 | A | 10/1973 | Munschy | |
| 3,925,913 | A | 12/1975 | Del Vecchio | |
| 4,136,468 | A | 1/1979 | Munschy | |
| 4,599,811 | A | 7/1986 | Rousseau | |
| 4,783,909 | A | 11/1988 | Van Doren et al. | |
| 5,012,598 | A | 5/1991 | Baggio et al. | |
| 5,699,629 | A | 12/1997 | Munschy | |
| 5,718,066 | A | 2/1998 | Chemello et al. | |
| 6,032,387 | A * | 3/2000 | Johnson | A43C 1/06 36/118.1 |
| 6,128,835 | A * | 10/2000 | Ritter | A43C 1/00 36/114 |
| 6,298,583 | B1 | 10/2001 | Allen | |
| 7,168,190 | B1 * | 1/2007 | Gillespie | A43B 3/24 36/102 |
| 7,721,468 | B1 * | 5/2010 | Johnson | A43C 1/06 36/118.1 |
| 7,752,774 | B2 | 7/2010 | Ussher | |
| 2002/0095823 | A1 | 7/2002 | Laio et al. | |
| 2005/0016027 | A1 * | 1/2005 | Trinkaus | A43B 3/0005 36/115 |
| 2005/0160627 | A1 | 7/2005 | Dalgaard et al. | |
| 2008/0066272 | A1 | 3/2008 | Hammerslag et al. | |
| 2008/0168683 | A1 | 7/2008 | Keating | |
| 2008/0307673 | A1 | 12/2008 | Johnson | |
| 2009/0184189 | A1 | 7/2009 | Soderberg et al. | |
| 2009/0272007 | A1 * | 11/2009 | Beers | A43B 3/0005 36/50.1 |
| 2010/0139057 | A1 | 6/2010 | Soderberg et al. | |
| 2010/0319216 | A1 | 12/2010 | Grenzke et al. | |
| 2011/0225843 | A1 | 9/2011 | Kerns et al. | |
| 2011/0266384 | A1 | 11/2011 | Goodman et al. | |
| 2012/0000091 | A1 | 1/2012 | Cotterman et al. | |
| 2012/0004587 | A1 | 1/2012 | Nickel et al. | |
| 2012/0017469 | A1 | 1/2012 | Kishino | |
| 2012/0079746 | A1 | 4/2012 | Ferreira et al. | |
| 2012/0204450 | A1 | 8/2012 | Girbaud | |
| 2012/0240428 | A1 | 9/2012 | Knoll | |
| 2013/0312293 | A1 | 11/2013 | Gerber | |

* cited by examiner

ARTICLE WITH ADJUSTABLE REARWARD COVERING PORTION

CROSS-REFERENCE TO RELATED APPLICATIONS

This application is a continuation of U.S. Patent Publication Number 2014/0360049, now U.S. patent application Ser. No. 13/913,632, filed Jun. 10, 2013 and titled "Article With Adjustable Rearward Covering Portion", the entirety of which is herein incorporated by reference. The appendix filed with U.S. patent application Ser. No. 13/913,632 is now U.S. Pat. No. 9,365,387, which is incorporated by reference in its entirety.

BACKGROUND

The present embodiments relate generally to articles of footwear, and in particular to an article of footwear with an adjustable upper.

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust the fit of the footwear, as well as permitting entry and removal of the foot from the void within the upper.

SUMMARY

In one aspect, an article of footwear includes a longitudinal direction extending from a forefoot portion to a heel portion of the article of footwear, a lateral direction extending from a lateral side to a medial side of the article of footwear and a vertical direction that is generally perpendicular to the longitudinal direction and the lateral direction. The article of footwear also includes a base portion for supporting a sole of a foot, where the base portion further includes a central portion and an outer peripheral portion. The article of footwear also includes a forward covering portion attached to the base portion, where the forward covering portion is associated with a forefoot of the foot and a rearward covering portion attached to the base portion, where the rearward covering portion is associated with a heel of the foot. The rearward covering portion further includes a first peripheral portion and a second peripheral portion, the first peripheral portion being associated with the outer peripheral portion of the base portion. The rearward covering portion has an open configuration for receiving the foot and a closed configuration for covering the foot. The article of footwear also includes a tensioning member associated with the rearward covering portion, where the tensioning member can be used to adjust the rearward covering portion between the open configuration and the closed configuration. The first peripheral portion has a vertical position that is substantially unchanged between the open configuration and the closed configuration. The vertical position of the second peripheral portion changes substantially between the open configuration and the closed configuration.

In another aspect, an article of footwear includes a base portion for supporting a sole of a foot, the base portion further including a central portion and an outer peripheral portion. The article of footwear also includes a forward covering portion attached to the base portion, where the forward covering portion is associated with a forefoot of the foot and a rearward covering portion attached to the base portion, where the rearward covering portion is associated with a heel of the foot. The rearward covering portion further includes a first peripheral portion and a second peripheral portion, the first peripheral portion being attached to the outer peripheral portion of the base portion. The rearward covering portion has an open configuration where the rearward covering portion is approximately flat and the rearward covering portion has a closed configuration where the rearward covering portion has a three-dimensional shape. The rearward covering portion has a U-like shape in the open configuration.

In another aspect, an article of footwear includes a base portion for supporting a sole of a foot, the base portion further including a central portion and an outer peripheral portion. The article of footwear also includes a forward covering portion attached to the base portion, where the forward covering portion is associated with a forefoot of the foot and a rearward covering portion attached to the base portion, where the rearward covering portion is associated with a heel of the foot. The rearward covering portion further includes a first peripheral portion and a second peripheral portion, the first peripheral portion being associated with the outer peripheral portion of the base portion. The rearward covering portion has an open configuration and a closed configuration. The rearward covering portion includes a rear portion and a first side portion. The rearward covering portion includes at least one preconfigured folding portion associated with the rear portion and the first side portion. The preconfigured folding portion facilitates folding between the rear portion and the first side portion when the rearward covering portion moves from the open configuration to the closed configuration.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
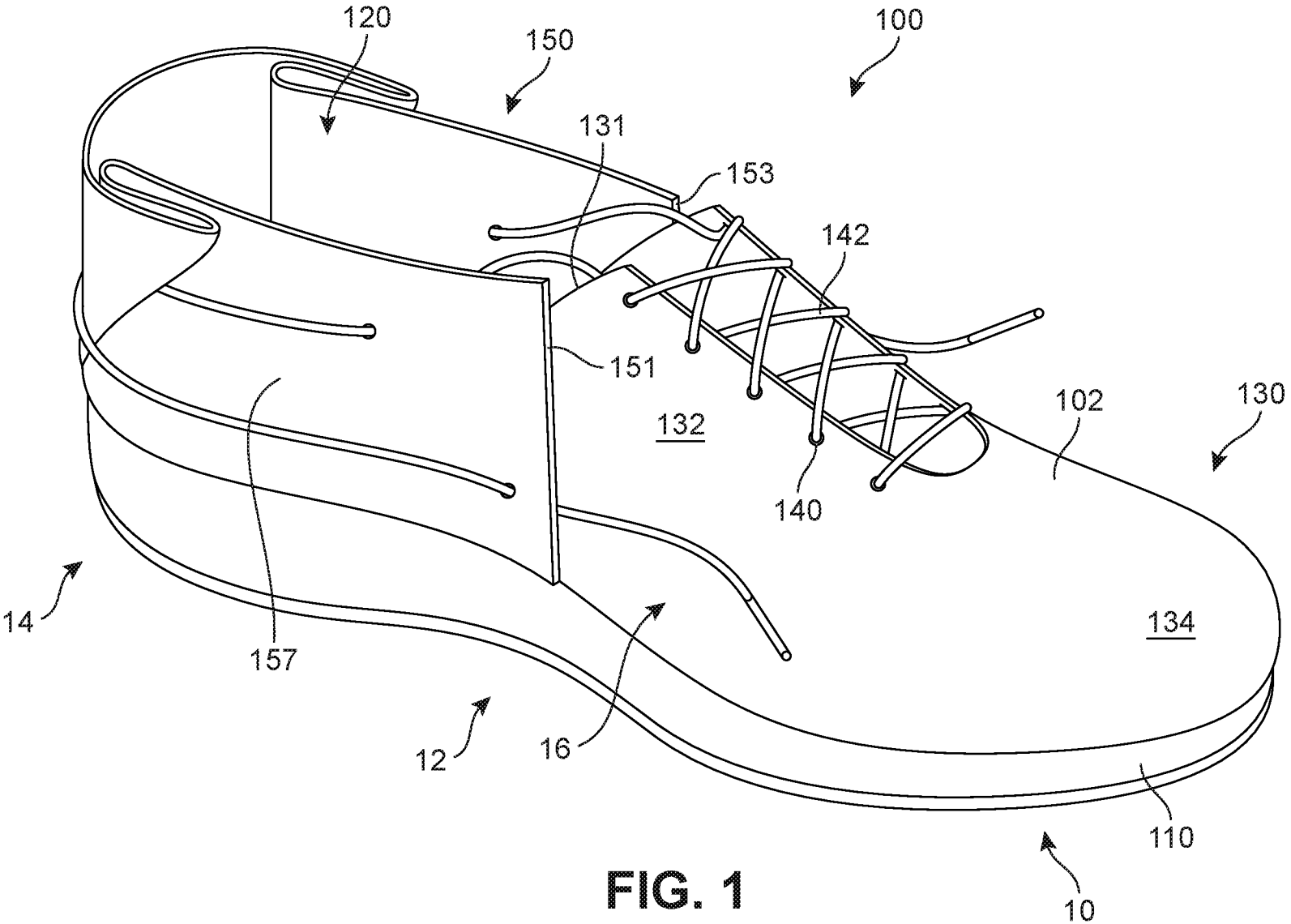
FIG. 1 is a front isometric view of an embodiment of an article of footwear including an adjustable rearward covering portion.
Figure 2:
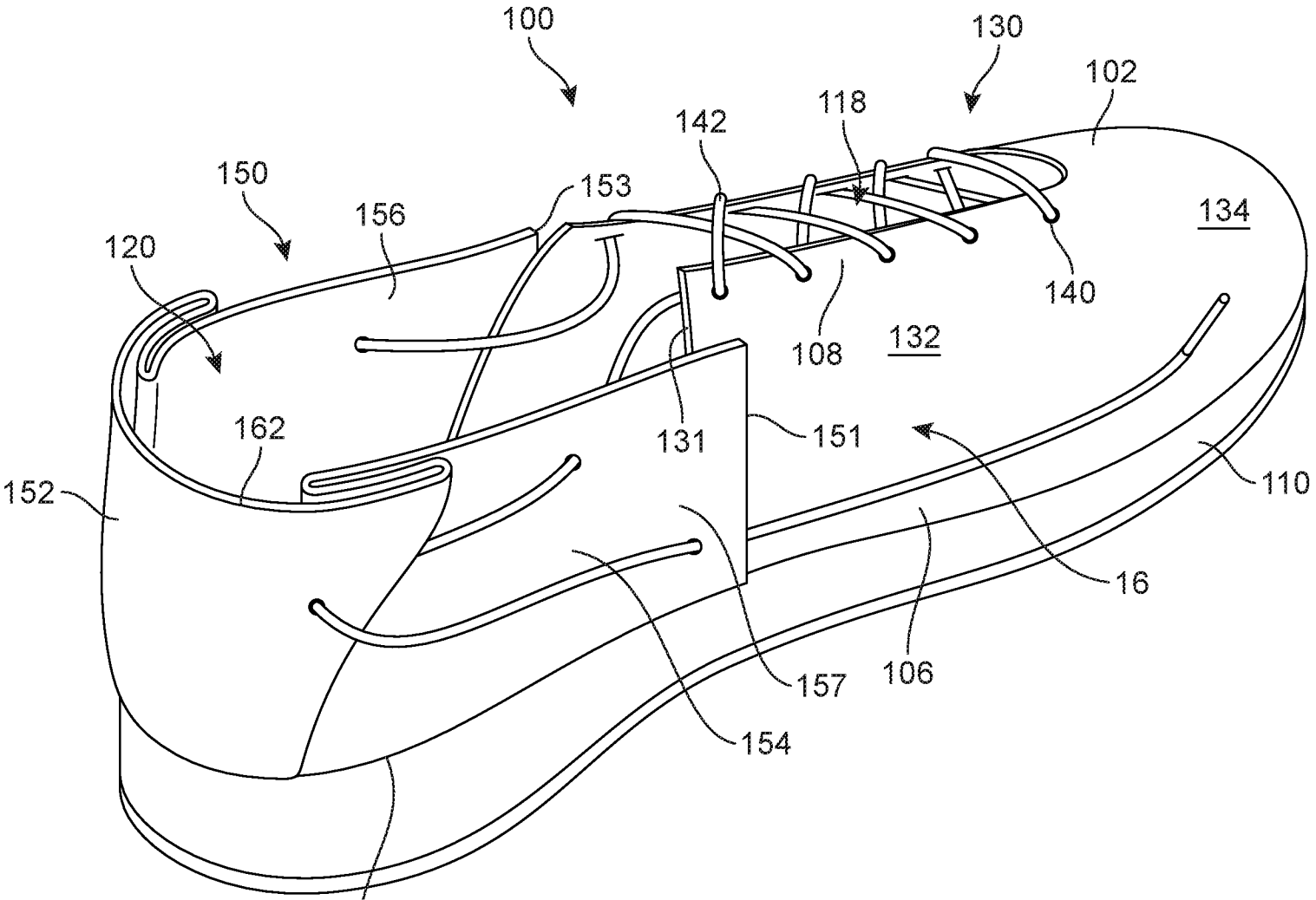
FIG. 2 is a rear isometric view of an embodiment of an article of footwear including an adjustable rearward covering portion, in which the lateral side of the article is visible.
Figure 3:
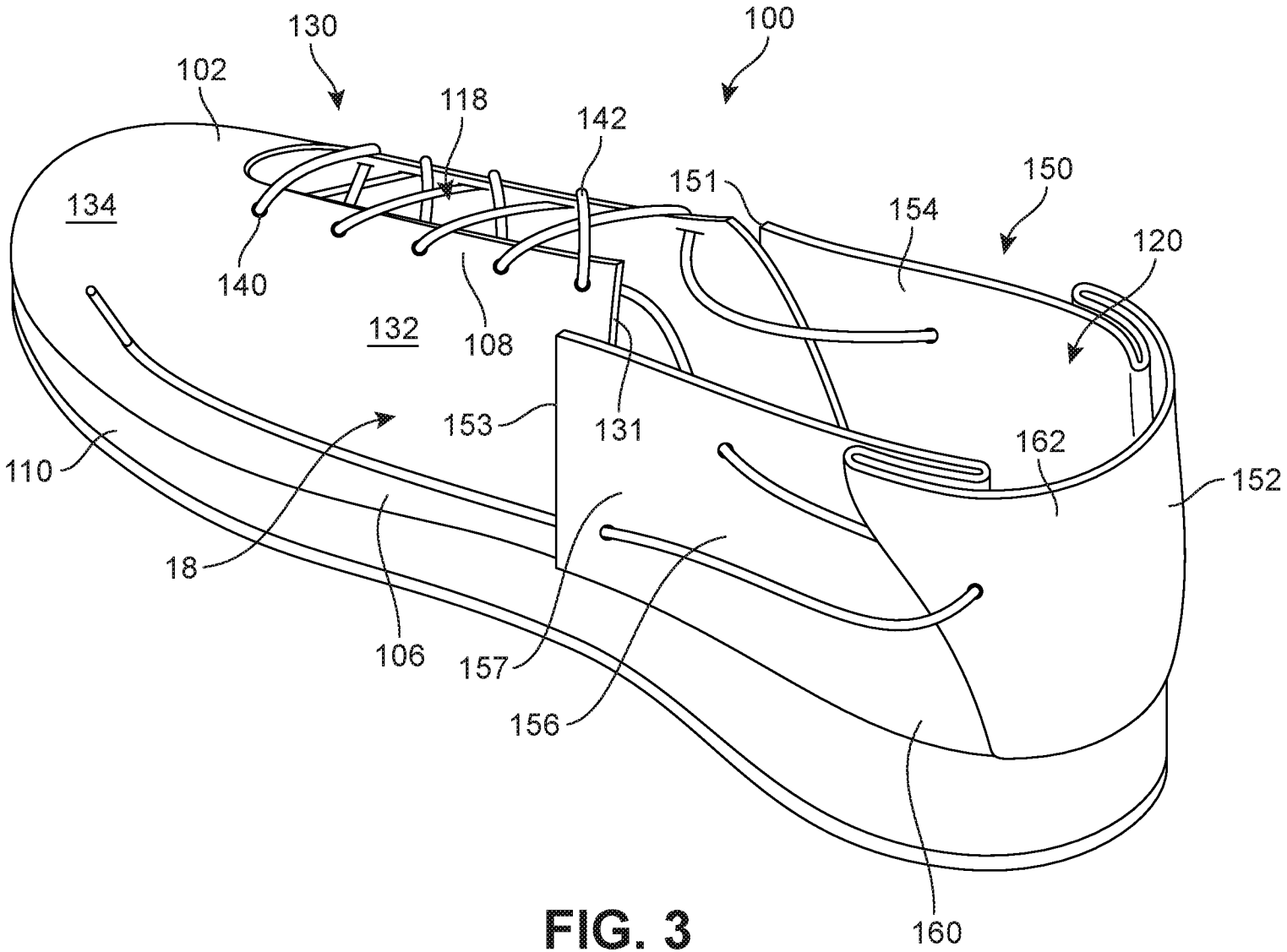
FIG. 3 is a rear isometric view of an embodiment of an article of footwear including an adjustable rearward covering portion, in which the medial side of the article is visible.

FIGS. 1 through 3 illustrate schematic isometric views of an embodiment of an article of footwear 100, also referred to simply as article 100. Article 100 may be configured for use with various kinds of footwear including, but not limited to: hiking boots, soccer shoes, football shoes, sneakers, running shoes, cross-training shoes, rugby shoes, basketball shoes, baseball shoes as well as other kinds of shoes. Moreover, in some embodiments article 100 may be configured for use with various kinds of non-sports related footwear, including, but not limited to: slippers, sandals, high heeled footwear, loafers as well as any other kinds of footwear, apparel and/or sporting equipment (e.g., gloves, helmets, etc.).

Referring to FIG. 1, for purposes of reference, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 100 may include lateral side 16 and medial side 18 (see FIG. 3). In particular, lateral side 16 and medial side 18 may be opposing sides of article 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 100. Likewise, lateral side 16 and medial side 18 are intended to represent generally two sides of an article, rather than precisely demarcating article 100 into two halves.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending along a width of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. In addition, the term "proximal" refers to a portion of a footwear component that is closer to a portion of a foot when an article of footwear is worn. Likewise, the term "distal" refers to a portion of a footwear component that is further from a portion of a foot when an article of footwear is worn. It will be understood that each of these directional adjectives may be used in describing individual components of an article, such as an upper and/or a sole structure.

Referring to FIGS. 1 through 3, article 100 may include an upper 102 as well as a sole structure 110. In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural turf, synthetic turf, dirt, as well as other surfaces.

Sole structure 110 is secured to upper 102 and extends between the foot and the ground when article 100 is worn. In different embodiments, sole structure 110 may include different components. For example, sole structure 110 may include an outsole, a midsole, and/or an insole. In some cases, one or more of these components may be optional. As discussed in further detail below, some embodiments may include sole structures with internal cavities or recesses for receiving various components, for example a cavity for receiving an electronic and/or mechanical device.

Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper.

An upper may be configured to cover some or all of a foot. In some embodiments, an upper may include multiple distinct portions that cover different portions of a foot. For example, in some cases, an upper may include a forward covering portion for covering portions of a foot including the forefoot and the toes. Likewise, in some cases, an upper may include a rearward covering portion for covering portions of a foot including the heel as well as portions of the foot adjacent to the heel.

In some embodiments, upper 102 may include a forward covering portion 130 and a rearward covering portion 150. In some cases, forward covering portion 130 may be associated with the forefoot of a foot (including the ball of the foot and the toes), while rearward covering portion 150 may be associated with the heel of a foot. Therefore, forward covering portion 130 and rearward covering portion 150 may together provide full coverage of a foot.

In some embodiments, forward covering portion 130 may overlap with rearward covering portion 150, such as at midfoot portion 12 of article 100. In an exemplary embodiment, rearward covering portion 150 may include a first forward edge 151 and a second forward edge 153 that overlap with the rearward edge 131 of forward covering portion 130. In other words, in some cases, the longitudinal positions of first forward edge 151 and/or second forward edge 153 may be forwards of the longitudinal position of rearward edge 131 of forward covering portion 130. In some embodiments, the overlap of rearward covering portion 150 and forward covering portion 130 may help cover the entirety of the sides of the foot. In other embodiments, however, first forward edge 151 and second forward edge 153 may be spaced apart from rearward edge 131 such that a gap or space is formed between rearward covering portion 150 and forward covering portion 130. In other words, in some other embodiments it is possible that first forward edge 151 and/or second forward edge 153 may be rearwards of rearward edge 131, with respect to the longitudinal direction.

In some embodiments, forward covering portion 130 may include a throat portion 132 and a toe box portion 134. Throat portion 132 and toe box portion 134 may together receive and cover the instep and toes of a foot. Forward covering portion 130 may also include a throat opening 136, which provides entry for the forefoot into an interior cavity 138 (see FIG. 5). Forward covering portion 130 may also include provisions for tightening throat portion 132. In some embodiments, forward covering portion 130 includes eyelets 140 that receive a tensioning member 142 (e.g., a lace), which can be used to close or tighten throat portion 132 around the forefoot. The arrangement of tensioning member 142 within article 100 is discussed in further detail below.

Rearward covering portion 150 may generally cover the heel as well as some of the sides of the foot. More specifically, in some embodiments, rearward covering portion 150 may extend rearwardly from forward covering portion 130 and circumscribe the heel. In some embodiments, rearward covering portion 150 may form an opening 120, which provides access into the interior of upper 102.

Embodiments can include provisions for facilitating easy foot entry into an article, especially for persons having injuries or other impairments that may make it difficult to maneuver the foot into the entry hole or opening of a traditional article of footwear. In some embodiments, a rearward covering portion may have different configurations to facilitate easier foot entry. For example, in some embodiments, a rearward covering portion could have an open configuration and a closed configuration. An open configuration may be one that allows easy entry of a foot into upper 102. In contrast, a closed configuration may be one that prevents easy removal of the foot from upper 102. In the open configuration, a user may easily insert his or her foot into forward covering portion 130 without interference from rearward covering portion 150. In the closed configuration, rearward covering portion 150 may wrap around the heel and sides of the foot, thereby restraining movement of the foot within upper 102. Moreover, in the open configuration, rearward covering portion 150 may provide substantially less coverage to the heel and sides of a foot than in the closed configuration.

Figure 4:
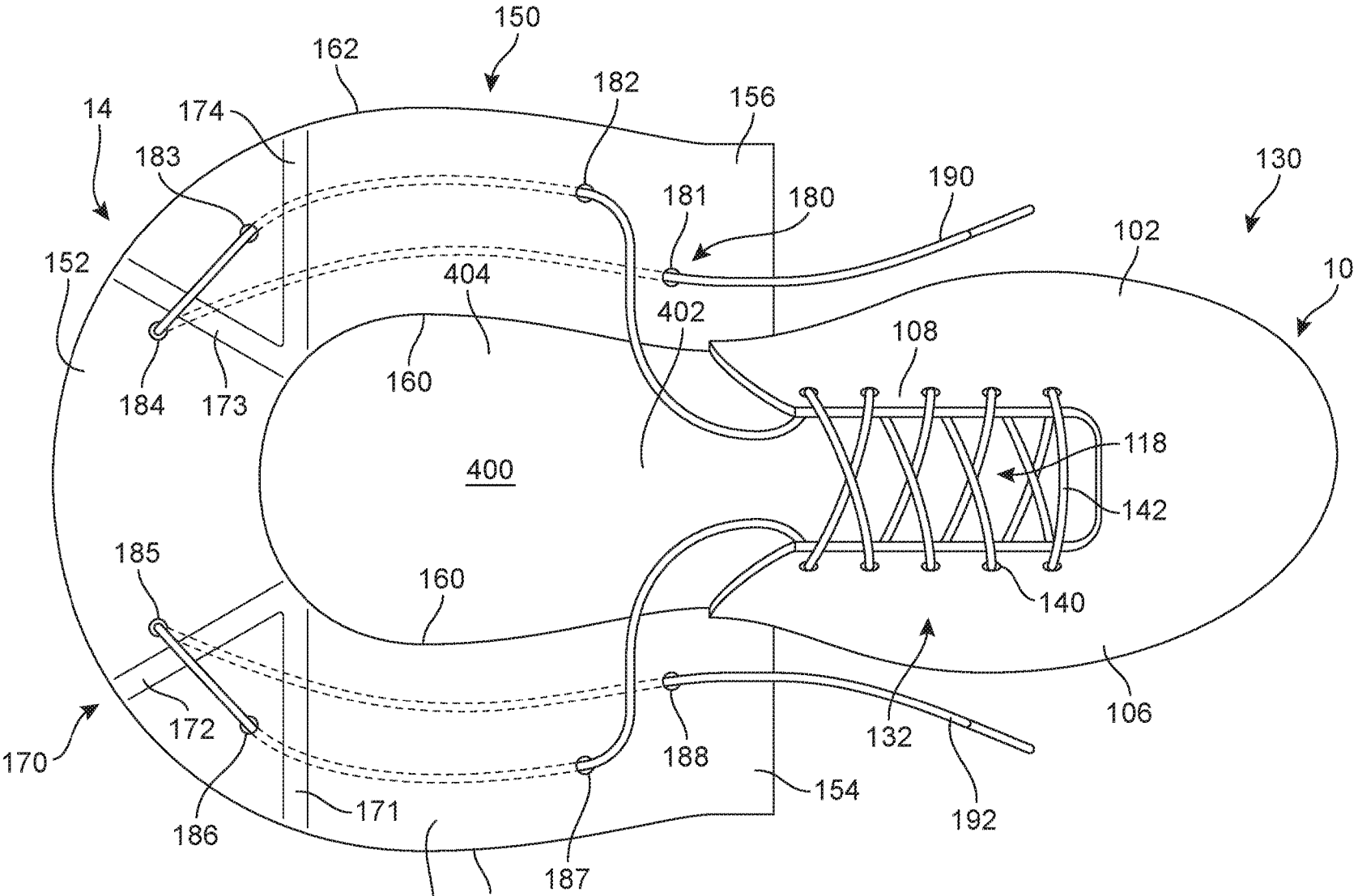
FIG. 4 is a top down view of an embodiment of an article of footwear including a rearward covering portion in an open configuration.

In the current embodiments, FIGS. 1 through 3 depict rearward portion 150 in a closed configuration. In contrast, FIG. 4 illustrates a top down view of an embodiment of article 100, in which rearward covering portion 150 is in an open configuration. As discussed in further detail below, rearward covering portion 150 may be put in the open configuration so that a foot can be easily received into forward covering portion 130. Once the foot is positioned within forward covering portion 130, rearward covering portion 150 may be put in the closed configuration to cover and support the heel and sides of the foot.

Referring now to FIGS. 2 through 4, rearward covering portion 150 includes portions to cover the heel of a foot as well as portions of the sides of the foot. In some embodiments, rearward covering portion 150 may therefore include a rear portion 152, a first side portion 154 and a second side portion 156.

Although the current embodiment includes a rear portion and two opposing side portions that enclose the heel and rear sides of the foot, other embodiments may be open at some portions. For example, in an alternative embodiment a rearward covering may not include first side portion 154, and may therefore not cover a foot on lateral side 16. Likewise, rear portion 152 and/or second side portion 156 could be optional in some embodiments.

In the embodiments of FIGS. 1 through 3 it is clear that rear portion 152, first side portion 154 and second side portion 156 may be integrally formed portions or sections of rearward covering portion 150. However, it will be understood that in other embodiments, one or more of rear portion 152, first side portion 154 and second side portion 156 could be disjoint or otherwise separated from adjacent portions. For example, in an alternative embodiment rear portion 152 may be separated from first side portion 154 and second side portion 156 by corresponding gaps or other provisions, such that rear portion 152 could move substantially independently of first side portion 154 and second side portion 156.

Rearward covering portion 150 may also include a first peripheral portion 160 and a second peripheral portion 162. First peripheral portion 160 may be associated with lower periphery 106 of upper 102, which is a portion of upper 102 disposed adjacent to sole structure 110. In contrast, second peripheral portion 162 may be associated with an upper periphery 108 of upper 102, which is a portion of upper 102 that is disposed adjacent to throat fastening region 118 and opening 120. In some embodiments, second peripheral portion 162 may be generally longer than first peripheral portion 160. This increased length for second peripheral portion 162 may allow rearward covering portion 150 to be folded and unfolded between the flat open configuration and the contoured closed configuration.

Referring now to FIG. 4, first peripheral portion 160 may be attached to, or otherwise extend from, base portion 400 of article 100. Base portion 400 may be configured to support a sole of a foot and may generally extend between forefoot portion 10 and heel portion 14 of article 100. In some embodiments, base portion 400 may be a portion of sole structure 110, including part of a midsole and/or insole. In other embodiments, however, base portion 400 could be a portion of an interior layer, such as an insert, which is disposed over sole structure 110. In still other embodiments, base portion 400 could be a portion of upper 102, for example, in embodiments where upper 102 extends across the lower surface of the foot.

In some embodiments, base portion 400 may include a central portion 402 and an outer peripheral portion 404. In some embodiments, first peripheral portion 160 of rearward covering portion 150 may be attached to, or otherwise extend from, outer peripheral portion 404 of base portion 400. The method and manner of attachment could vary from one embodiment to another. In one exemplary embodiment, first peripheral portion 160 may be joined to the outer surface of outer peripheral portion 404, using adhesives, stitching or any other methods of joining/bonding materials. In another embodiment in which base portion 400 is an insole or other insert, first peripheral portion 160 could be attached to an inner surface of outer peripheral portion 404 that faces towards sole structure 110.

Article 100 can include provisions to facilitate changing rearward covering portion 150 from the open configuration (FIGS. 4 and 5) to the closed configuration (FIGS. 1-3). In some embodiments, rearward covering portion 150 may be configured to fold in one or more locations. In some embodiments, rearward covering portion 150 may fold along some or all of first peripheral portion 160. In other words, rearward covering portion 150 may fold at its region of attachment to, or extension from, base portion 400.

Figure 5:
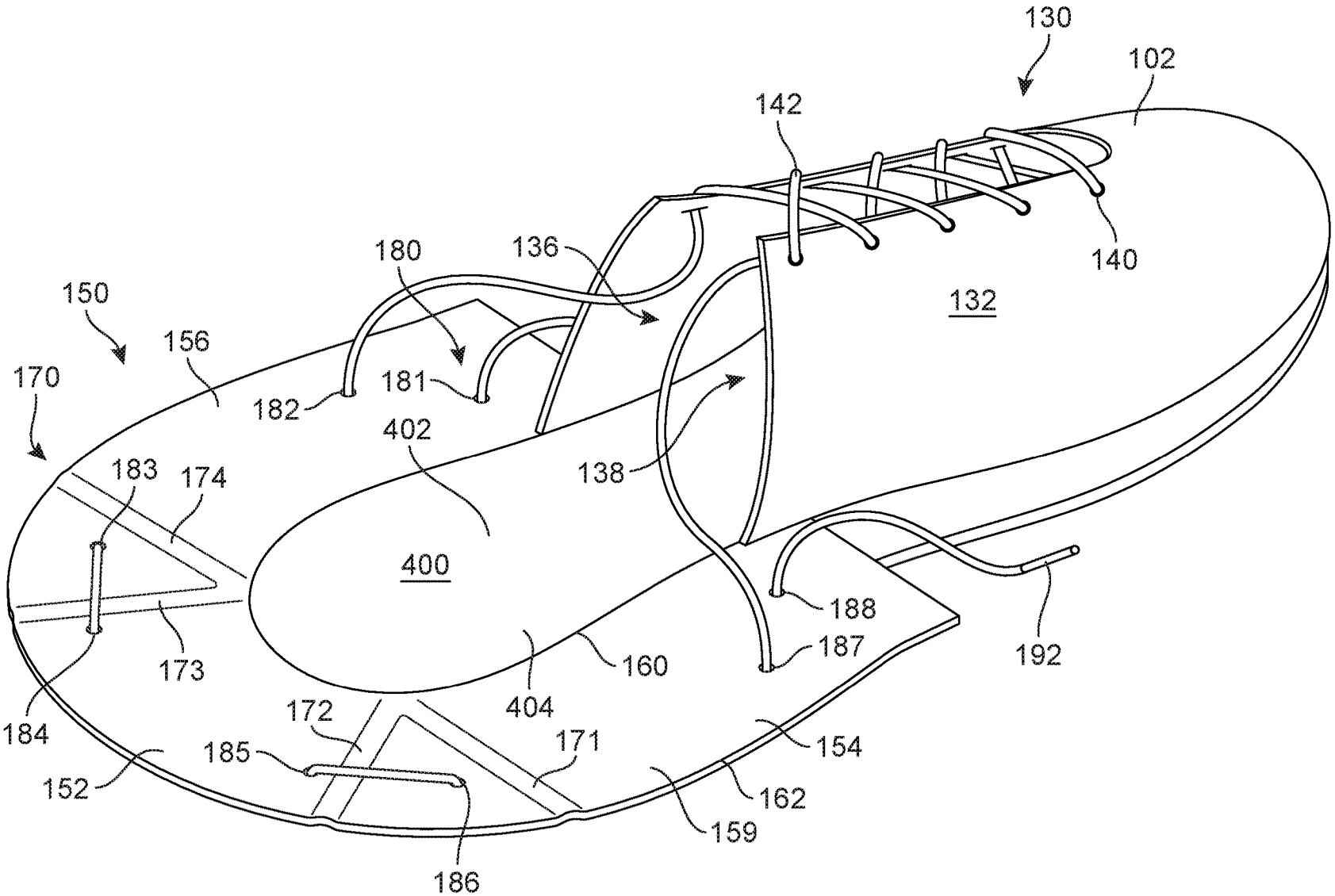
FIG. 5 is a rear isometric view of an embodiment of an article of footwear including a rearward covering portion in an open configuration.

FIG. 5 illustrates a schematic isometric view of article 100 with rearward covering portion 150 in the open configuration. As seen by comparing the open configuration of FIGS. 4 and 5 with the closed configuration of FIGS. 1-3, the geometry of rearward covering portion 150 may generally change between a relatively flat geometry and a three-dimensional geometry, respectively. This may be achieved by folding rearward covering portion 150 along first peripheral portion 160 so that rearward covering portion 150 achieves an approximately vertically upright position as discussed in further detail below.

With respect to the individual portions of rearward covering portion 150, each of rear portion 152, first side portion 154 and second side portion 156 may each fold about first peripheral portion 160. Moreover, when folded, each of rear portion 152, first side portion 154 and second side portion 156 moves from a generally horizontal configuration to a generally vertical configuration.

Embodiments can include provisions to facilitate folding between rear portion 152, first side portion 154 and second side portion 156. For example, some embodiments can use one or more preconfigured folding portions. The term "preconfigured folding portion" as used throughout this detailed description and in the claims refers to any portion that may be biased towards folding when certain kinds of forces are applied. In particular, a preconfigured folding portion may be used to ensure folding (or more generally bending) occurs at a predefined location. Thus, preconfigured folding portions can facilitate controlled folding of materials to ensure that a material is folded in a desired manner.

Referring to FIGS. 4 and 5, rearward covering portion 150 may include a plurality of preconfigured folding portions 170. Plurality of preconfigured folding portions 170 may include at least one preconfigured folding portion. An exemplary embodiment includes four preconfigured folding portions, including a first preconfigured folding portion 171, a second preconfigured folding portion 172, a third preconfigured folding portion 173 and a fourth preconfigured folding portion 174. However, other embodiments could include any other number such as one, two, three, four, five or more than five preconfigured folding portions.

The positions and orientations of one or more preconfigured folding portions could vary. In some embodiments, the positions and/or orientations may be selected to ensure the desired folding occurs between rear portion 152, first side portion 154 and second side portion 156. In some embodiments, first preconfigured folding portion 171 and second preconfigured folding portion 172 extend in a V-like configuration from first peripheral portion 160 to second peripheral portion 162. Moreover, first preconfigured folding portion 171 and second preconfigured folding portion 172 are generally associated with first side portion 154 and rear portion 152. In some embodiments, first preconfigured folding portion 171 and second preconfigured folding portion 172 may be disposed between first side portion 154 and rear portion 152. In a similar manner, third preconfigured folding portion 173 and fourth preconfigured folding portion 174 extend in a V-like configuration from first peripheral portion 160 to second peripheral portion 162. Moreover, third preconfigured folding portion 173 and fourth preconfigured folding portion 174 are generally associated with second side portion 156 and rear portion 152. In some embodiments, third preconfigured folding portion 173 and fourth preconfigured folding portion 174 may be disposed between second side portion 156 and rear portion 152.

In other embodiments preconfigured folding portions could be disposed in any other portions of rearward covering portion 150. For example, in other embodiments, preconfigured folding portions could be disposed in the middle of first side portion 154 and/or second side portion 156. Likewise, in some embodiments, preconfigured folding portions could be disposed in the middle of rear portion 152.

In different embodiments, a preconfigured folding portion may be achieved in different ways. In some embodiments, a preconfigured folding portion can be formed in a material using heat and/or pressure to form permanent ridges or channels in a section of material that facilitate folding along the ridges or channels. For example, in a material incorporating a thermoplastic layer or structure, permanent ridges could be formed by melting the thermoplastic layer in a manner that forms ridges and cooling the layer to set the geometry. In other embodiments, however, a preconfigured folding portion could be formed by attaching two disjoint materials in a manner that predisposes them to bending. Still other embodiments could use any methods or provisions known in the art for forming permanent regions where folding occurs within a material.

Embodiments can include provisions to control the configuration of rearward covering portion 150. In some embodiments, one or more tensioning members could be used to pull rearward covering portion 150 from the open configuration to the closed configuration. Examples of tensioning members that could be used include, but are not limited to: cables, cords, wires, laces, straps as well as any other kinds of tensioning members known in the art. In an exemplary embodiment, tensioning member 142 has the form of a shoelace and may be used to control the configuration of rearward covering portion 150 as described below.

In some embodiments, rearward covering portion 150 can include one or more apertures for receiving tensioning member 142. In some embodiments, rearward covering portion 150 may include plurality of apertures 180. Plurality of apertures 180 may comprise eight apertures including first aperture 181, second aperture 182, third aperture 183, fourth aperture 184, fifth aperture 185, sixth aperture 186, seventh aperture 187 and eighth aperture 188. It will be understood that while the embodiments in the figures include eight apertures, other embodiments could include any number of apertures. Some embodiments, for example, could include less than eight apertures. Still other embodiments could include more than eight apertures.

In different embodiments, the arrangement of one or more apertures on rearward covering portion 150 could vary. Generally, the arrangement of apertures could be selected to achieve a desired configuration for a tensioning member along rearward covering portion 150. The following discussion describes one exemplary configuration, however the embodiments are not limited to this configuration. As seen in FIGS. 4 and 5, first aperture 181 and second aperture 182 may be disposed on second side portion 156, while seventh aperture 187 and eighth aperture 188 may be disposed on first side portion 154. In addition, third aperture 183 and fourth aperture 184 may be disposed on opposing sides of third preconfigured folding portion 173, while fifth aperture 185 and sixth aperture 186 may be disposed on opposing sides of second preconfigured folding portion 172.

The specific arrangement of plurality of apertures 180 shown in the figures allows tensioning member 142 to be placed along rearward covering portion 150 in a manner that facilitates adjusting rearward covering portion 150 between the open and closed configurations. Starting from a first end portion 190, tensioning member 142 may be inserted through first aperture 181. From first aperture 181, a portion of tensioning member 142 may extend along outward facing surface 157 of rearward covering portion 150 (see FIGS. 1-3) to fourth aperture 184. From fourth aperture 184, a portion of tensioning member 142 may extend along inward facing surface 159 of rearward covering portion 150 to third aperture 183. From third aperture 183, a portion of tensioning member 142 may extend along outward facing surface 157 to second aperture 182. From second aperture 182, an intermediate portion of tensioning member 142 extends through eyelets 140 in order to tension throat portion 132 of forward covering portion 130.

A portion of tensioning member 142 may exit eyelets 140 on forward covering portion 130 and extend to seventh aperture 187 on rearward covering portion 150. From seventh aperture 187, a portion of tensioning member 142 extends on outward facing surface 157 to sixth aperture 186, then along inward facing surface 159 to fifth aperture 185. From fifth aperture 185, a portion of tensioning member 142 extends on outward facing surface 157 to eighth aperture 188 at which point tensioning member 142 extends outwardly and terminates at second end portion 192.

This configuration for tensioning member 142 may facilitate folding rearward portion 150 into the closed position whenever tension is applied to tensioning member 142, especially at first end portion 190 and second end portion 192. Moreover, the specific configuration may facilitate both vertical folding of rear portion 152, first side portion 154 and second side portion 156 and folding between portions. This includes folding between rear portion 152 and first side portion 154 as well as folding between rear portion 152 and second side portion 156.

It will be understood that in some embodiments additional provisions could be used to control the positioning and travel of portions of tensioning member 142 through or along rearward covering portion 150. As one example, some other embodiments could incorporate external guides that may be attached to outward facing surface 157 and/or inward facing surface 159 of rearward covering portion 150. In some embodiments the relative dimensions of a rearward covering portion and a tensioning member could be selected so that the tensioning member can extend through tunnels or channels within the rearward covering portion (i.e., between inward facing surface 159 and outward facing surface 157).

In some embodiments, a single tensioning member could be used to tension forward covering portion 130 and rearward covering portion 150 simultaneously. Specifically, the tensioning member could be used to tighten forward covering portion 130 and also to move rearward covering portion 150 to the closed configuration (under the appropriate amount of tension). However, in other embodiments, forward covering portion 130 and rearward covering portion 150 could have independent tensioning members, which would allow for forward covering portion 130 and rearward covering portion 150 to be tensioned independently.

As seen in FIGS. 4 and 5, in some embodiments rearward covering portion 150 may be approximately flat in the open configuration. In particular, rearward covering portion 150 may be approximately parallel with the longitudinal and lateral directions in the open configuration. In other embodiments, however, rearward covering portion 150 may not be fully flat in the open configuration. Instead, in some cases, rearward covering portion 150 may still be substantially more flat in the open configuration than in the closed configuration.

FIGS. 4 and 5 also clearly illustrate the U-like or horseshoe-like geometry of rearward covering portion 150, especially in the open configuration. In particular, in some embodiments, first peripheral portion 160 and second peripheral portion 162 may comprise the inner and outer boundaries of a U-like or horseshoe-like section of material. This U-like shape helps to provide full coverage around the heel and adjacent sides of a foot, when rearward covering portion 150 is raised to the closed configuration.

Figure 6:
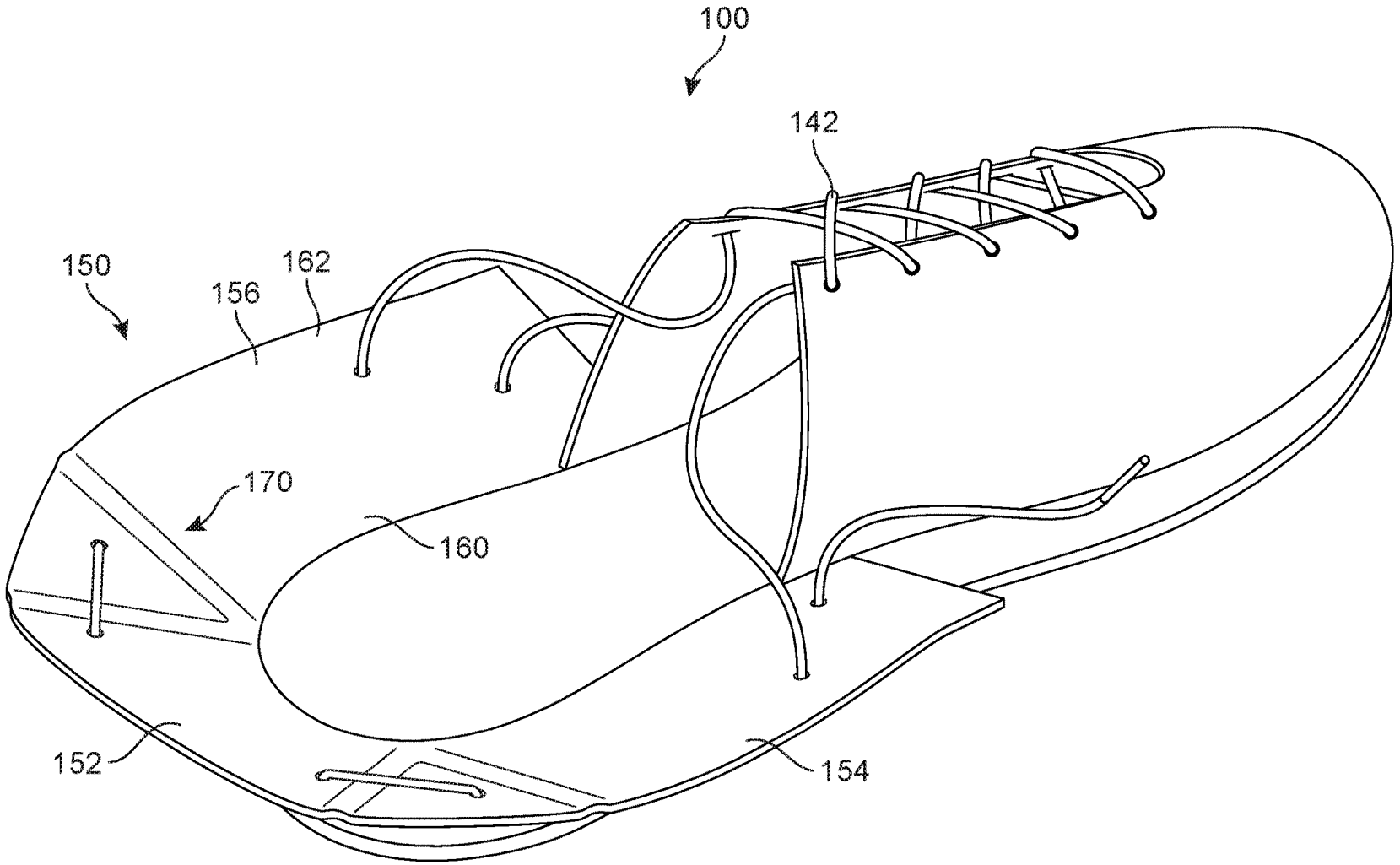
FIG. 6 is a rear isometric view of an embodiment of an article of footwear including a rearward covering portion; in which the rearward covering portion is closing.
Figure 7:
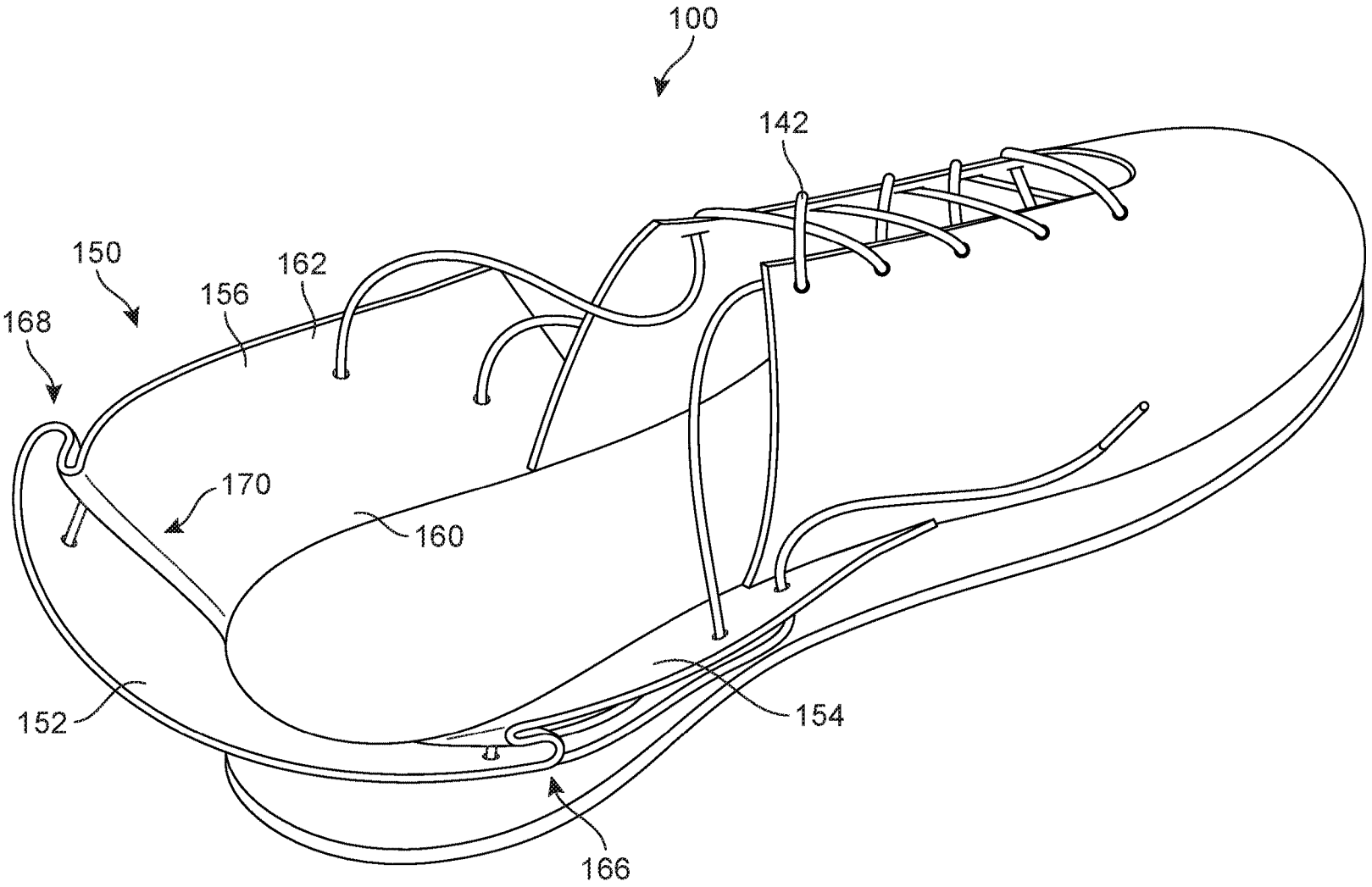
FIG. 7 is a rear isometric view of an embodiment of an article of footwear including a rearward covering portion; in which the rearward covering portion is closing.
Figure 8:
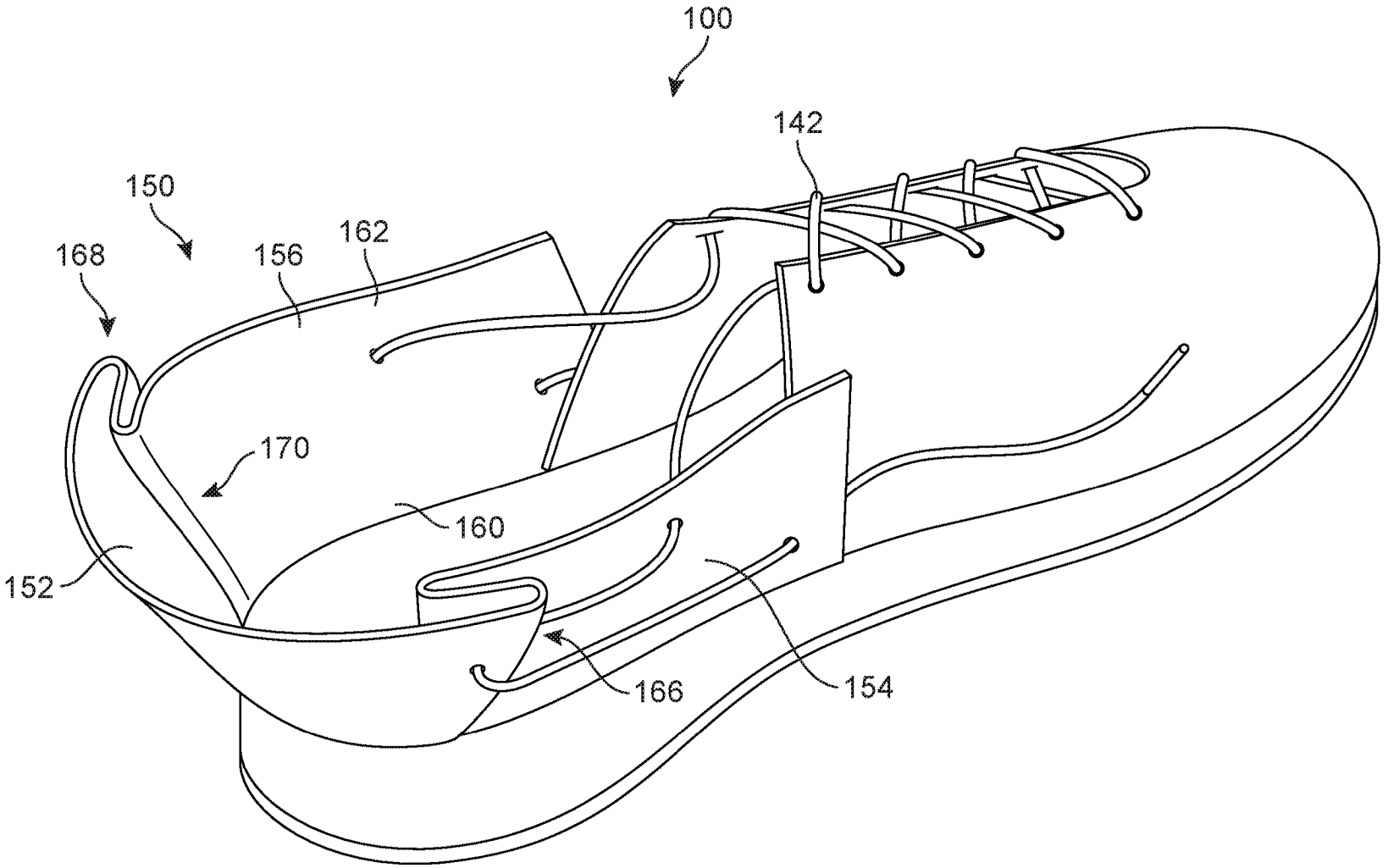
FIG. 8 is a rear isometric view of an embodiment of an article of footwear including a rearward covering portion; in which the rearward covering portion is closing.
Figure 9:
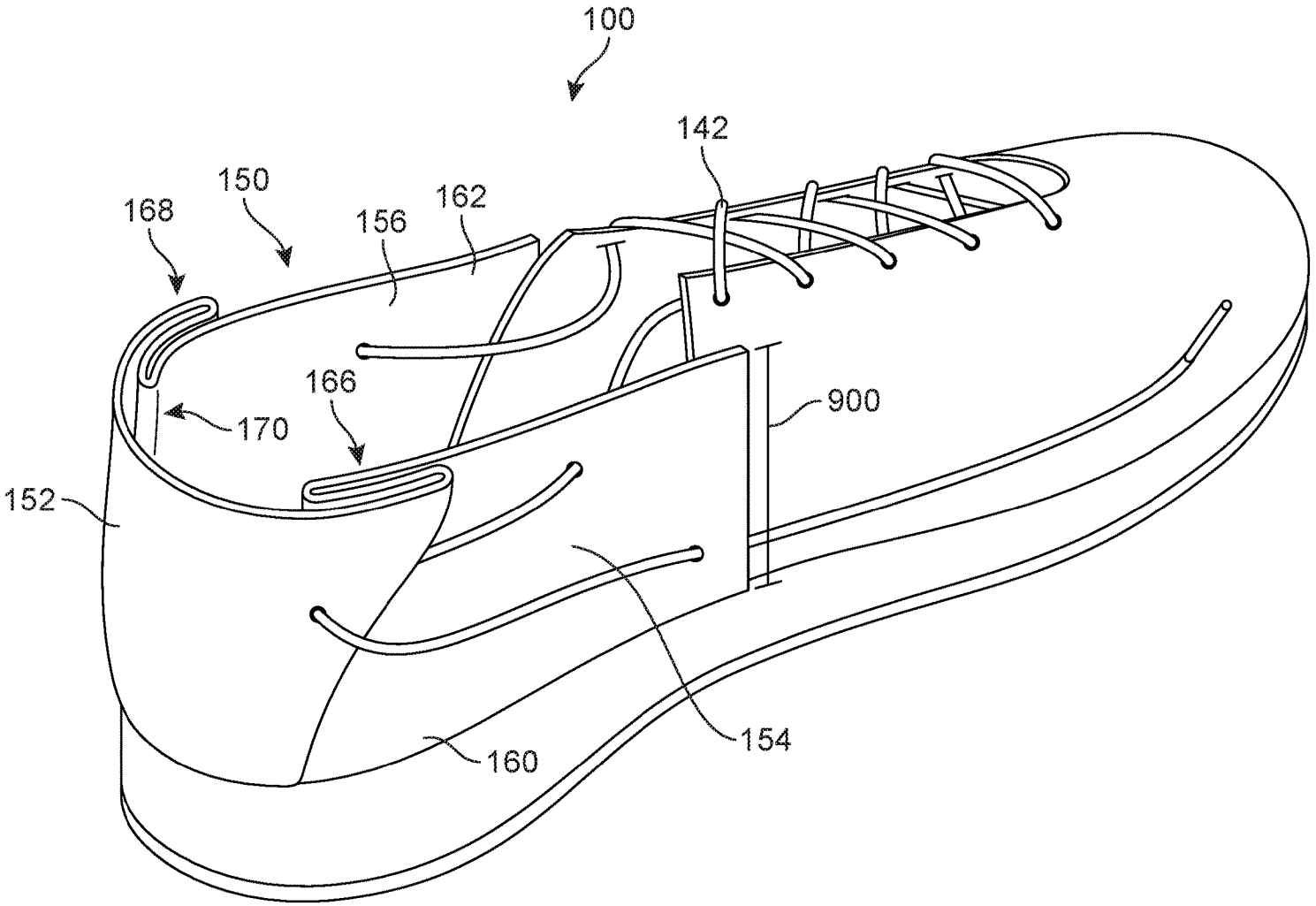
FIG. 9 is a rear isometric view of an embodiment of an article of footwear including a rearward covering portion in a closed configuration.

FIGS. 6 through 9 illustrate schematic isometric views of various stages of article 100 in which rearward covering portion 150 is in various different positions or arrangements. In particular, starting first with FIG. 5, FIGS. 5 through 9 depict a sequence of configurations for rearward covering portion 150 between the open configuration (FIG. 5) and the closed configuration (FIG. 9). FIGS. 6 through 8 in particular depict intermediate configurations that are between the open configuration and the closed configuration.

Referring to FIGS. 5 through 9, as the tension of tensioning member 142 is increased, rearward covering portion 150 begins to fold. In some embodiments, rear portion 152, first side portion 154 and second side portion 156 each fold about first peripheral portion 160 such that each portion folds towards an approximately upright (or vertical) position. In addition, as the tension in tensioning member 142 is increased, rearward covering portion 150 may fold along plurality of preconfigured folding portions 170. Specifically, under enough tension, a first folded section 166 and a second folded section 168 are formed (see FIGS. 7 through 9). First folded section 166 and second folded section 168 accommodate the excess material that forms as rearward covering portion 150 is closed.

As rearward covering portion 150 moves from the open configuration to the closed configuration, the position of second peripheral portion 162 can be seen to change. In particular, while first peripheral portion 160 remains approximately in place throughout the closing process, the vertical position (or height) of second peripheral portion 162 is increased from the open configuration to the closed configuration. In some embodiments, in the open configuration, second peripheral portion 162 may have a vertical position that is approximately equal to the vertical position of base portion 400 (which may also be the approximate vertical position of first peripheral portion 160). As clearly seen in FIGS. 6 through 8, as rearward covering portion 150 continues to move into the closed position, the vertical position of second peripheral portion 162 relative to base portion 400 gradually increases. Finally, as seen in FIG. 9, the vertical position of second peripheral portion 162 has a maximum vertical position relative to base portion 400 (indicated schematically as vertical position 900). This vertical position 900 may be approximately equal to the width of first side portion 154.

Figure 10:
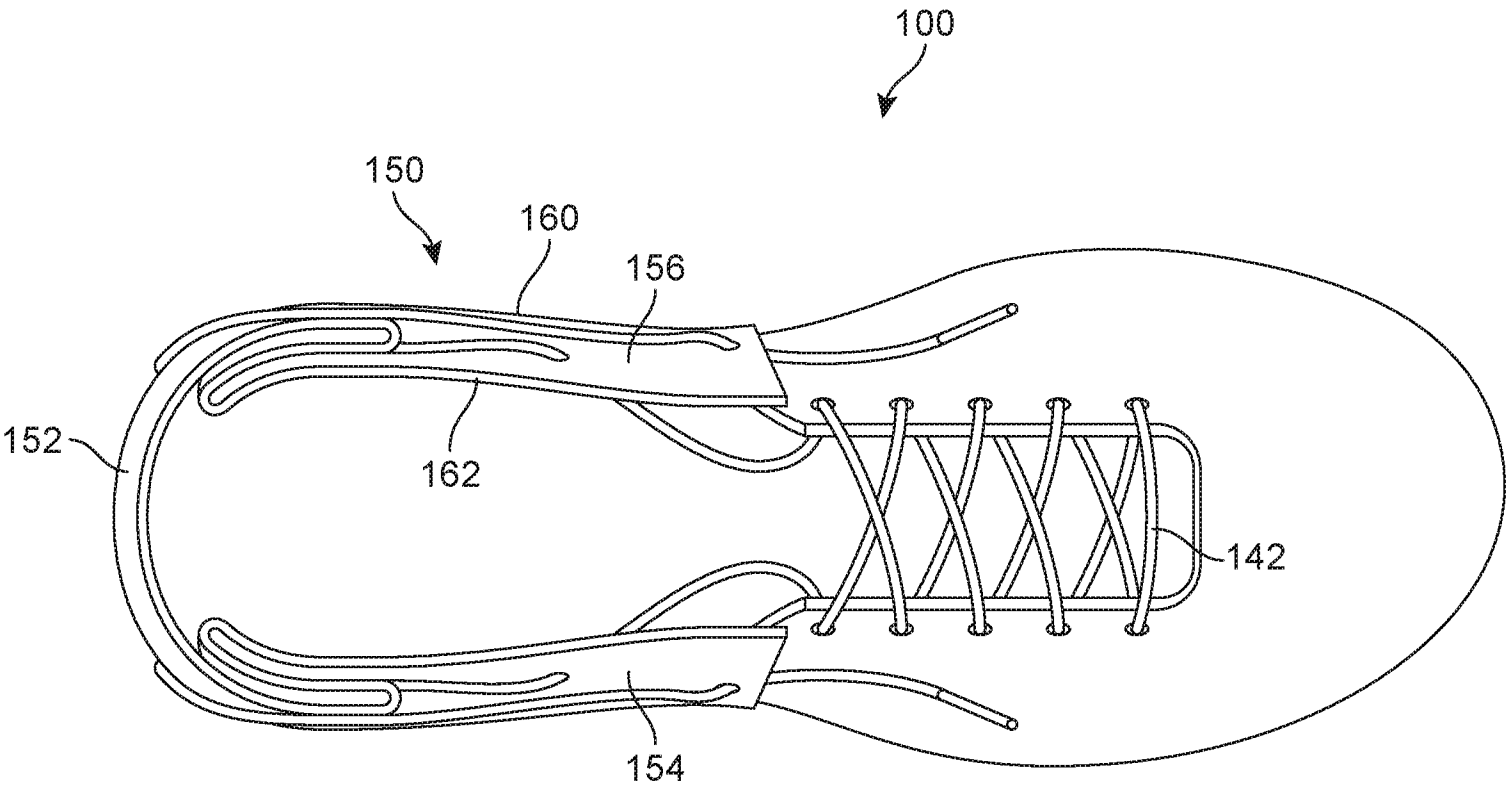
FIG. 10 is a top down view of an embodiment of an article of footwear including a rearward covering portion in a closed configuration.

Additionally, as rearward covering portion 150 closes, the horizontal distance (i.e. a distance in the longitudinal and/or lateral directions) between second peripheral portion 162 and first peripheral portion 160 decreases. This can be clearly seen by comparing the horizontal positions of first peripheral portion 160 and second peripheral portion 162 in FIG. 5 with their positions in FIG. 10. FIG. 10 illustrates a top down view of article 100 with rearward covering portion 150 in the closed configuration. In open configuration shown in FIG. 5, first peripheral portion 160 and second peripheral portion 162 are spaced apart in the horizontal direction by an amount approximately equal to the width of first side portion 154, second side portion 156 or rear portion 152. In the closed configuration shown in FIG. 10, second peripheral portion 162 is disposed over first peripheral portion 160, so that their horizontal separation is substantially narrowed.

It will be understood that the terms open configuration and closed configuration as used throughout the detailed description and in the claims are intended to refer to relative configurations of rearward covering portion 150. In some other embodiments, the open configuration and the closed configuration may be slightly different than the configurations illustrated in the figures. For example, the open configuration could be associated with any of the intermediate configurations shown in FIGS. 6 through 8. Likewise, the closed configuration could be associated with any of the intermediate configurations shown in FIGS. 6 through 8, as long as the closed configuration is closer to the vertically upright configuration (shown in FIG. 9) than the open configuration. Moreover, in use, there are situations where rearward covering portion 150 may not achieve a closed position that is completely vertically upright. For example, if a user is wearing a cast that is substantially wider than base portion 400, a fully closed configuration for rearward covering portion 150 may be closer to the approximate position shown in FIG. 8. This provides for increased versatility for article 100.

Figure 11:
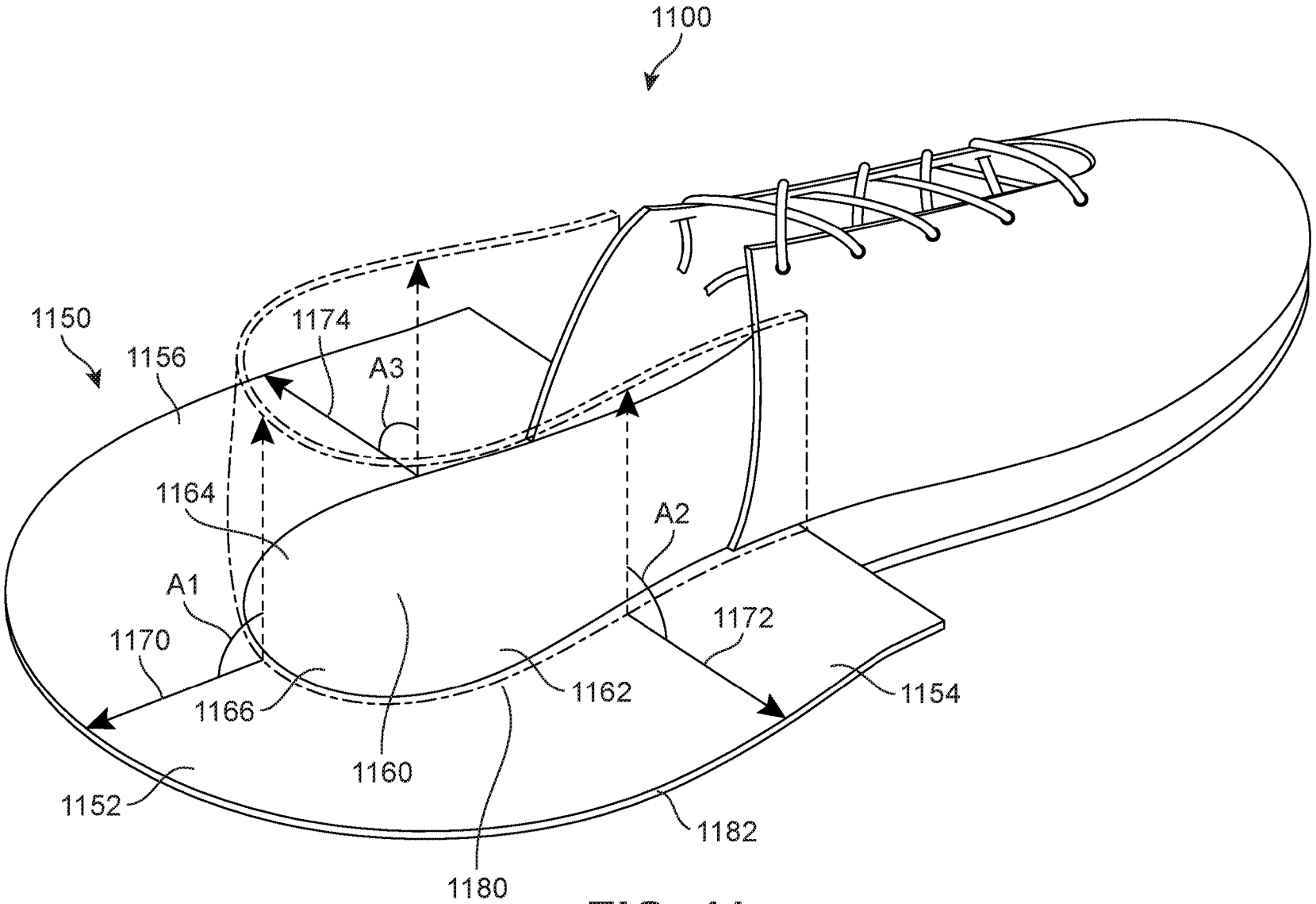
FIG. 11 is a rear isometric view of an embodiment of an article of footwear in which a rearward covering portion is shown schematically in an open position and a closed position.

FIG. 11 illustrates a schematic isometric view of an embodiment of an article 1100, which is intended to schematically depict the folding of a rearward covering portion 1150. In particular, the emphasis in FIG. 11 is on the vertical folding of a rear portion 1152, a first side portion 1154 and a second side portion 1156. For purposes of clarity, folding between adjacent portions is not shown. Furthermore, provisions for adjusting rearward covering portion 1150 (including a tensioning member, apertures and preconfigured folding portions) are not shown in this embodiment to improve clarity.

Referring to FIG. 11, each of rear portion 1152, first side portion 1154 and second side portion 1156 are attached to a base portion 1160 of article 1100. Base portion 1160 includes a first side peripheral portion 1162, a second side peripheral portion 1164 and a rear peripheral portion 1166. In some cases, first side portion 1154 may be attached to base portion 1160 at first side peripheral portion 1162 and second side portion 1156 may be attached to base portion 1160 at second side peripheral portion 1164. Likewise, rear portion 1152 may be attached to rear peripheral portion 1166.

Each portion of rearward covering portion 1150 may be configured to fold from a generally horizontal position (shown in solid in FIG. 11) to a generally vertical position (shown in phantom in FIG. 11). For purposes of illustration, each portion is shown with an arrow that depicts the approximate orientation of the portion. In particular, each portion is depicted with an arrow that generally extends along the portion between an inner peripheral portion 1180 of rearward covering portion 1150 and an outer peripheral portion 1182 of rearward covering portion 1150. Thus, first arrow 1170, second arrow 1172 and third arrow 1174 depict the approximate orientations of rear portion 1152, first side portion 1154 and second side portion 1156, respectively. Here, each arrow is generally tangential to the surfaces of each portion.

As rear portion 1152, first side portion 1154 and second side portion 1156 are folded from the open configuration to the closed configuration of rearward covering portion 1150, each portion is rotated by a corresponding angle A1, angle A2 and angle A3, respectively. In some embodiments, angle A1, angle A2 and angle A3 may be approximately similar angles. In other embodiments, two or more of angle A1, angle A2 and angle A3 may be substantially different angles. In one exemplary embodiment, angle A1, angle A2 and angle A3 may all have a value approximately in the range between 70 degrees and 110 degrees. In other embodiments, however, one or more angles could have values less than 70 degrees. In still other embodiments, one or more angles could have values greater than 110 degrees. As one example, angle A1, angle A2 and angle A3 are all depicted as having a value of about 90 degrees in FIG. 11.

Figure 12:
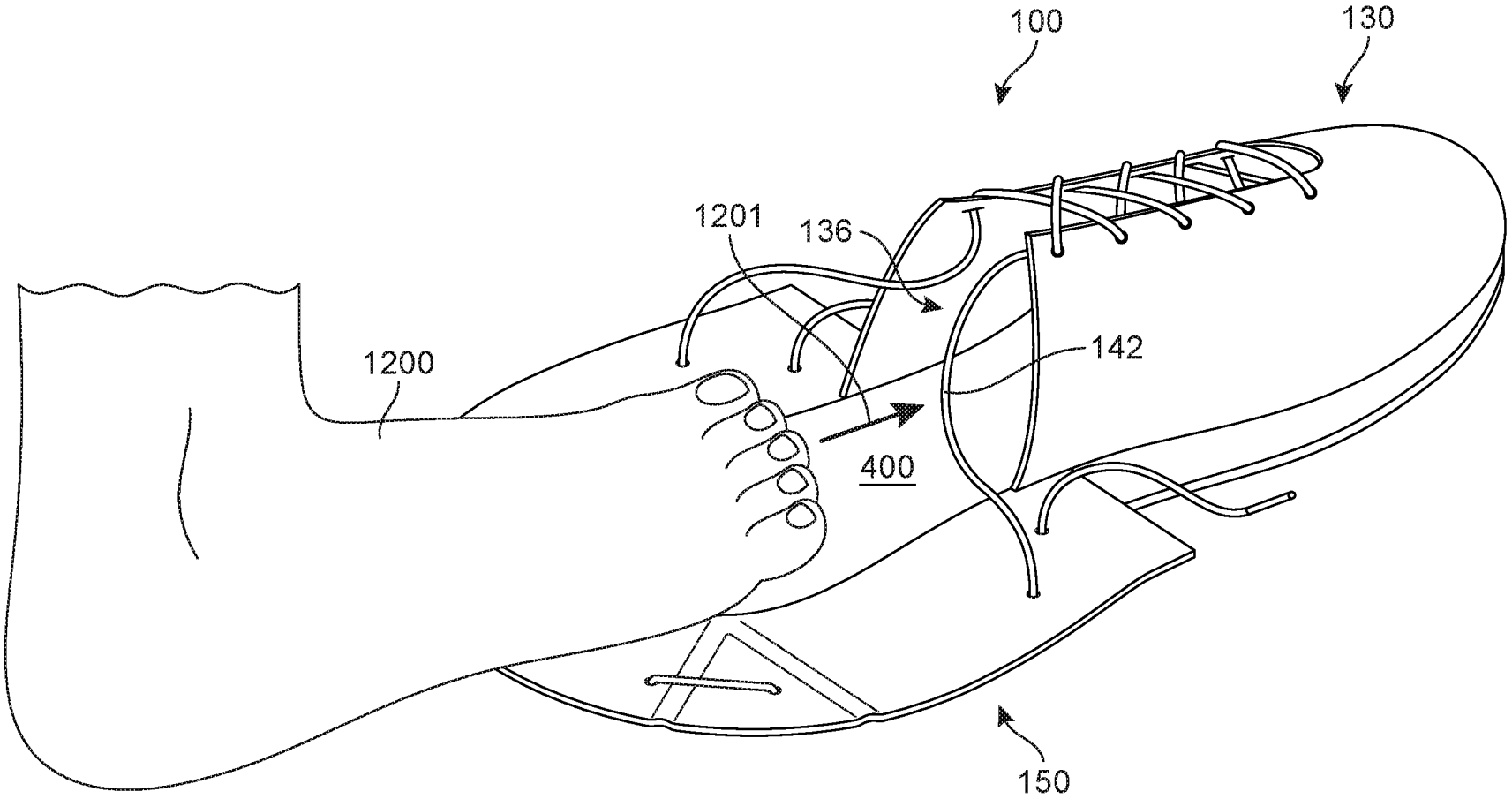
FIG. 12 is a rear isometric view of a foot being inserted into an article of footwear with an open rearward covering portion, according to an embodiment.
Figure 13:
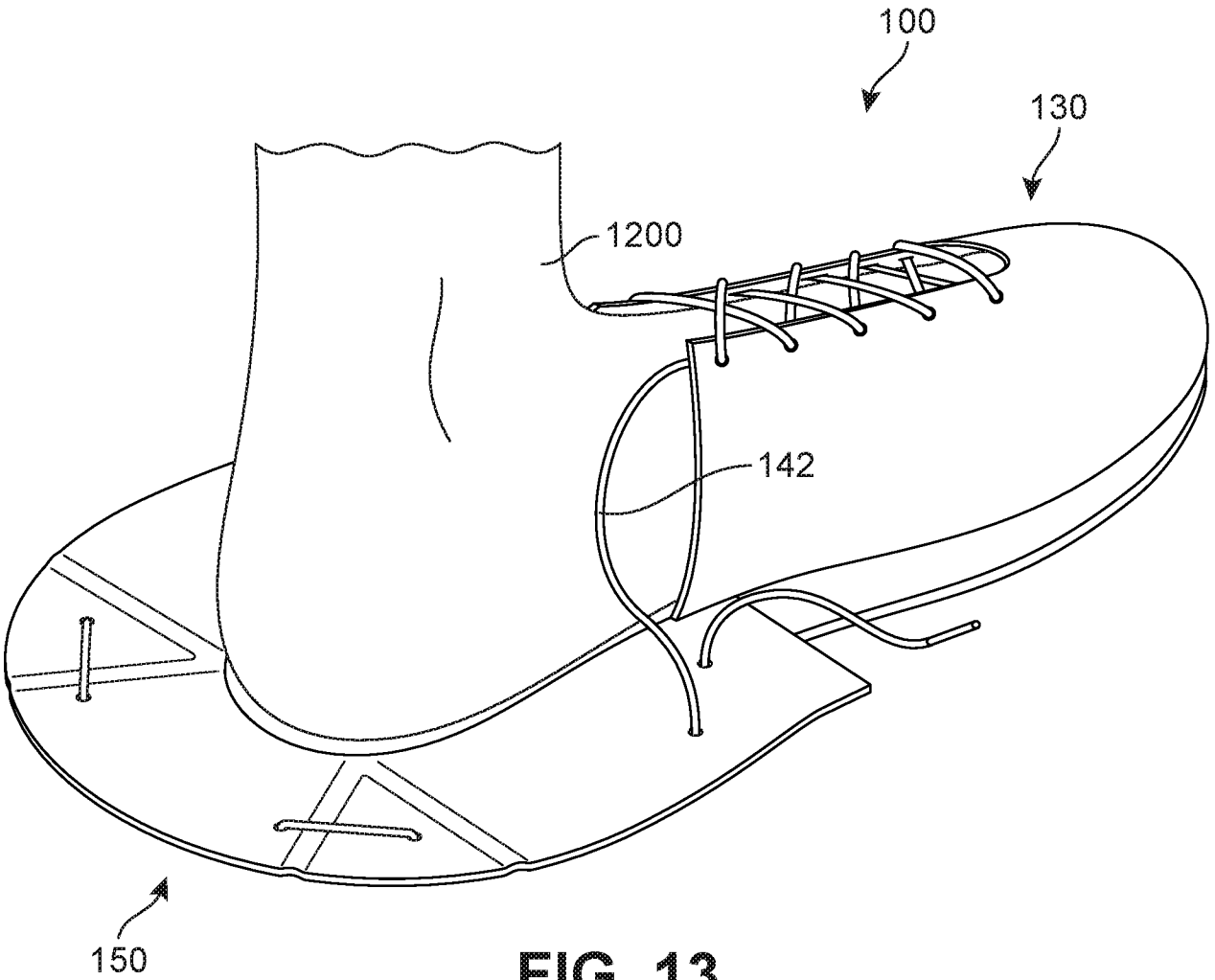
FIG. 13 is a rear isometric view of a foot fully inserted into an article of footwear with an open rearward covering portion, according to an embodiment.
Figure 14:
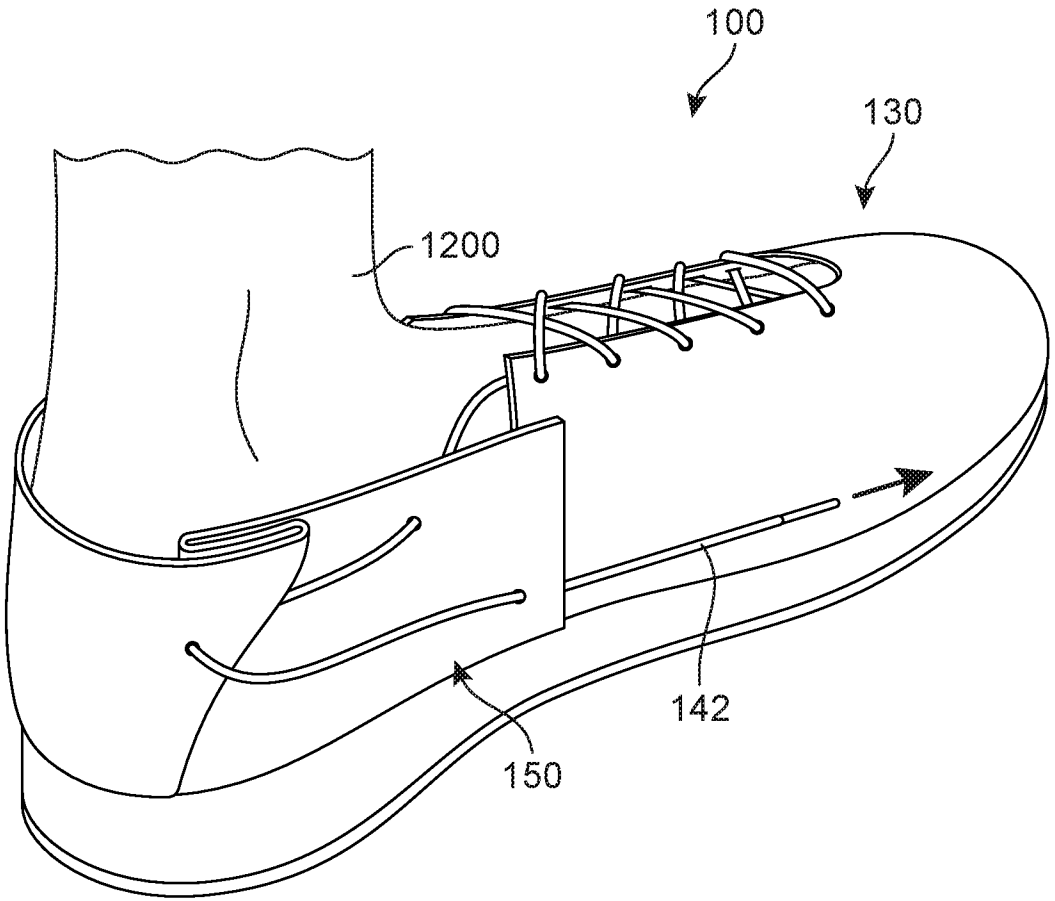
FIG. 14 is a rear isometric view of a foot fully inserted into an article of footwear with an open rearward covering portion closed around the foot, according to an embodiment.

FIGS. 12 through 14 depict an example of article of footwear 100 in use. As seen in FIG. 12, with rearward covering portion 150 in the open configuration, a user's foot 1200 may be inserted directly into forefoot covering portion 130 through throat opening 136. As depicted in FIG. 12, foot 1200 may be inserted along a generally longitudinal direction. The longitudinal direction (indicated schematically as direction 1201) may be approximately parallel with base portion 400. This helps reduce any need for the foot to be bent during insertion into forefoot covering portion 130. Such a provision may be helpful for users with foot injuries, or other medical conditions (such as arthritis in the foot) that might make inserting a foot into a traditional upper opening more difficult.

With foot 1200 full inserted into forefoot covering portion 130, foot 1200 may supported below by base portion 400, as seen in FIG. 13. Finally, rearward covering portion 150 can be closed around the heel of foot 1200 by increasing tension in tensioning member 142 in the manner illustrated in FIGS. 6 through 9. The resulting configuration is shown in FIG. 14.

Figure 15:
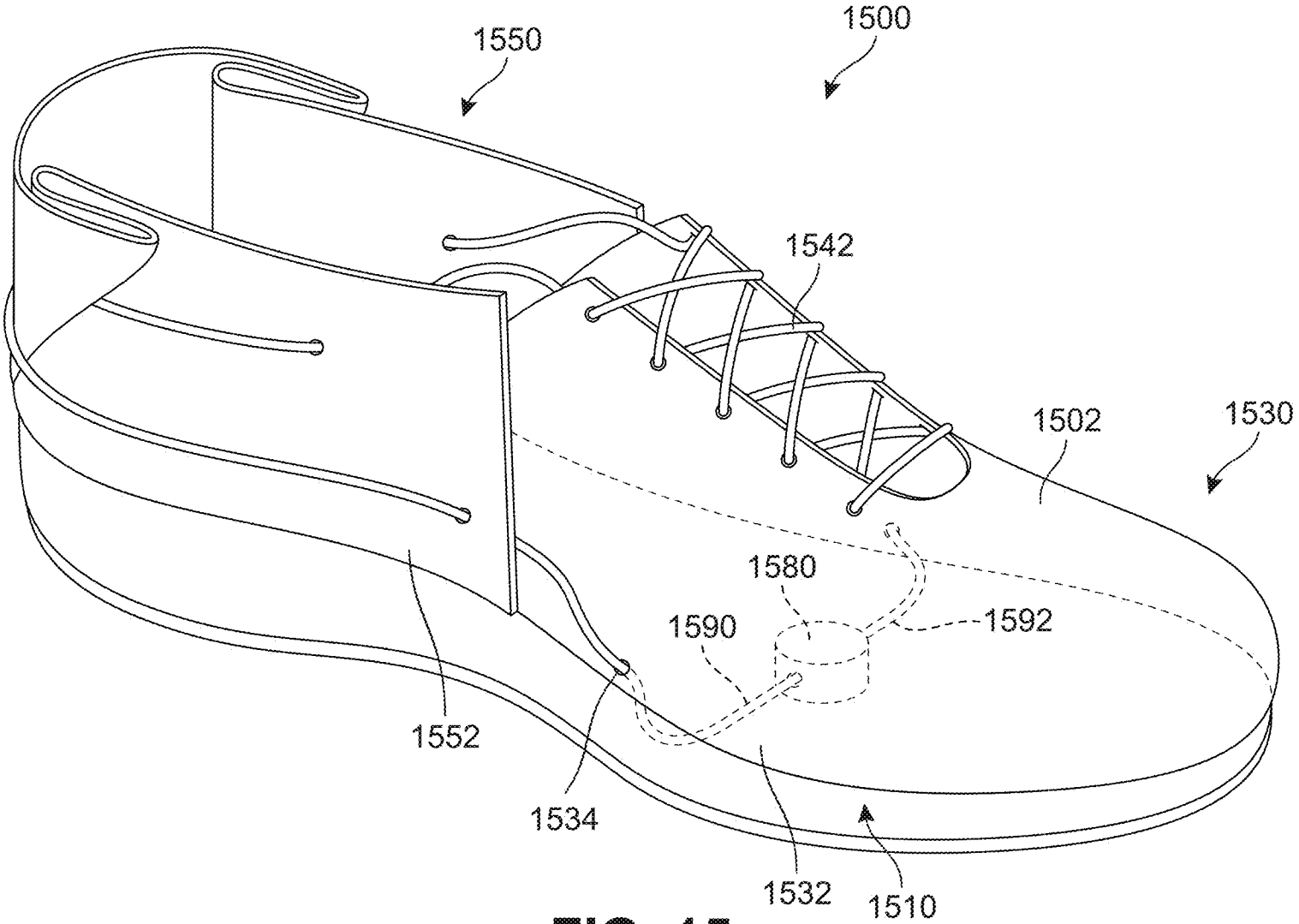
FIG. 15 is a schematic isometric view of an embodiment of an article of footwear including an automated tensioning device.

FIG. 15 illustrates a schematic isometric view of an embodiment of an article 1500. Article 1500 may be similar in some respects to article 100 described above. In particular, article 1500 includes upper 1502 with forward covering portion 1530 and rearward covering portion 1550.

In order to facilitate easy tensioning of a tensioning member 1542, which may be used to tighten forward covering portion 1530 as well as to open and close rearward covering portion 1550, article 1500 may include a tensioning device 1580. Tensioning device 1580 could be a manual tensioning device and/or an automated tensioning device. For purposes of clarity, tensioning device 1580 is shown schematically in the current embodiments. However, tensioning device 1580 may generally include provisions for receiving and winding tensioning members. Examples of different tensioning devices include, but are not limited to: reel devices with a ratcheting mechanism, reel devices with a cam mechanism, manual tensioning devices, automatic tensioning devices, as well as possibly other kinds of tensioning devices. Examples of a tensioning device comprising a reel and ratcheting mechanism that could be used with the current embodiments are disclosed in Soderberg et al., U.S. Pat. 8,468,657, issued on Jun. 25, 2013 and titled "Reel Based Lacing System", the entirety of which is hereby incorporated by reference. Examples of a motorized tensioning device that could be used with the current embodiments are disclosed in Beers et al., U.S. Pat. No. 9,365,487, issued on Jun. 14, 2016, and titled "Motorized Tensioning System with Sensors", the entirety being incorporated by reference herein. In an exemplary embodiment, tensioning device 1580 could be a motorized reel-based tensioning device that winds a tensioning member onto a reel to increase the tension.

In different embodiments, the location of tensioning device 1580 could vary. In some embodiments, tensioning device 1580 could be associated with upper 1502. In other embodiments, tensioning device 1580 may be associated with a sole structure 1510 of article 1500. In an exemplary embodiment, tensioning device 1580 may be disposed within sole structure 1510, for example in a cavity of a midsole of sole structure 1510. As shown in FIG. 15, the tensioning member 1542 may extend along an outward facing surface 1552 of the rearward covering portion 1550 and extend from an outward facing surface 1532 of the forward covering portion 1530 through an opening 1534 located in the lower periphery of the outward facing surface 1532 of the forward covering portion 1530.

A first end portion 1590 and a second end portion 1592 of tensioning member 1542 may be inserted into tensioning device 1580. In some cases, first end portion 1590 and second end portion 1592 may be attached to a reel or spool inside tensioning device 1580. As the reel or spool is rotated, tensioning member 1542 may be wound or unwound. In some embodiments, a motor may be used to power tensioning device 1580. Furthermore, in some cases, a remote device may be used to control tensioning device 1580 using any wireless communication technology including, but not limited to: infrared communication, radio communication or any other kinds of wireless communication known in the art.

Some embodiments could make use of one or more sensors to automatically adjust the tension of tensioning member 1542. For example, in one embodiment one or more sensors may detect when the foot has been inserted into forward covering portion 1530 and automatically adjust tensioning member 1542 to close rearward covering portion 1550 around the heel.

While some of the embodiments illustrate an article without a tongue, other embodiments of an article with foldable rearward covering portion may include a tongue. A tongue may therefore be optional and the decision to incorporate a tongue or not incorporate a tongue into an article may be determined by various factors such as desired instep cushioning and whether a tongue may be needed to help adjust the fit of the foot within the article.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. An article of footwear, comprising:

a longitudinal direction extending from a forefoot portion to a heel portion of the article of footwear;

a lateral direction extending from a lateral side to a medial side of the article of footwear;

a vertical direction that is generally perpendicular to the longitudinal direction and the lateral direction;

a base portion configured to support a sole of a foot, the base portion including a central portion and an outer peripheral portion;

an upper comprising a forward covering portion and a rearward covering portion, the upper having an upper periphery and a lower periphery, wherein the upper periphery includes a portion of the upper disposed adjacent to a throat fastening region and the lower periphery includes a portion of the upper disposed adjacent to a sole structure of the article of footwear;

the forward covering portion attached to the base portion, wherein the forward covering portion is configured to cover a portion of a forefoot of the foot;

the rearward covering portion attached to the base portion, wherein the rearward covering portion is configured to cover a portion of a heel of the foot;

the rearward covering portion further including a first peripheral portion and a second peripheral portion, the first peripheral portion being attached to the outer peripheral portion of the base portion;

the rearward covering portion having an open configuration configured to receive the foot and a closed configuration configured to cover the foot;

a tensioning member extending through a plurality of apertures within the rearward covering portion and also extending through a plurality of apertures within the upper periphery of the forward covering portion, the tensioning member further extending along an outward facing surface of the rearward covering portion and extending from an outward facing surface of the forward covering portion through an opening located in the lower periphery of the outward facing surface of the forward covering portion, wherein the tensioning member adjusts the rearward covering portion between the open configuration and the closed configuration, the tensioning member having a first end portion and a second end portion;

a tensioning device attached to the first end portion and the second end portion of the tensioning member to adjust tension in the tensioning member;

wherein the first peripheral portion has a vertical position that is substantially unchanged between the open configuration and the closed configuration; and wherein a vertical position of the second peripheral portion changes substantially between the open configuration and the closed configuration.

2. The article of footwear according to claim 1, wherein the tensioning device is a manual tensioning device.

3. The article of footwear according to claim 1, wherein the tensioning device is an automatic tensioning device.

4. The article of footwear according to claim 1, wherein the tensioning device is disposed within the sole structure of the article of footwear.

5. The article of footwear according to claim 1, wherein a remote device controls the tensioning device using a wireless communication technology.

6. An article of footwear, comprising:

a base portion configured to support a sole of a foot, the base portion including a central portion and an outer peripheral portion;

an upper comprising a forward covering portion and a rearward covering portion, the upper having an upper periphery and a lower periphery, wherein the upper periphery includes a portion of the upper disposed adjacent to a throat fastening region and the lower periphery includes a portion of the upper disposed adjacent to a sole structure of the article of footwear;

the forward covering portion attached to the base portion, wherein the forward covering portion is configured to cover a portion of a forefoot of the foot;

the rearward covering portion attached to the base portion, wherein the rearward covering portion is configured to cover a portion of a heel of the foot;

the rearward covering portion further including a first peripheral portion and a second peripheral portion, the first peripheral portion being attached to the outer peripheral portion of the base portion;

the rearward covering portion having an open configuration where the rearward covering portion is approximately flat and the rearward covering portion having a closed configuration where the rearward covering portion has a three-dimensional shape;

wherein the rearward covering portion has a U-like shape in the open configuration;

a tensioning member extending through a plurality of apertures within the upper periphery of the forward covering portion and also extending through a plurality of apertures within the rearward covering portion, the tensioning member further extending along an outward facing surface of the rearward covering portion and extending from an outward facing surface of the forward covering portion through an opening located in the lower periphery of the outward facing surface of the forward covering portion, wherein the tensioning member includes a first end portion and a second end portion; and an automatic tensioning device configured to automatically adjust tension in the tensioning member, wherein the automatic tensioning device is attached to the first end portion and the second end portion of the tensioning member to adjust tension in the tensioning member.

7. The article of footwear according to claim 6, wherein the automatic tensioning device increases the tension in the tensioning member to change the rearward covering portion from the open configuration to the closed configuration.

8. The article of footwear according to claim 7, wherein the automatic tensioning device decreases the tension in the tensioning member to change the rearward covering portion from the closed configuration to the open configuration.

9. The article of footwear according to claim 6, wherein the first end portion and the second end portion are both inserted into the automatic tensioning device.

10. The article of footwear according to claim 9, further comprising a sensor to detect when the foot has been inserted into the forward covering portion and automatically adjust tension in the tensioning member to close the rearward covering portion around the heel and into the closed configuration.

11. The article of footwear according to claim 6, wherein the automatic tensioning device is positioned in the sole structure of the article of footwear.

12. An article of footwear, comprising:

a base portion configured to support a sole of a foot, the base portion including a central portion and an outer peripheral portion;

an upper comprising a forward covering portion and a rearward covering portion, the upper having an upper periphery and a lower periphery, wherein the upper periphery includes a portion of the upper disposed adjacent to a throat fastening region and the lower periphery includes a portion of the upper disposed adjacent to a sole structure of the article of footwear;

the forward covering portion attached to the base portion, wherein the forward covering portion is configured to cover a portion of a forefoot of the foot;

the rearward covering portion attached to the base portion, wherein the rearward covering portion is configured to cover a portion of a heel of the foot;

the rearward covering portion further including a first peripheral portion and a second peripheral portion, the first peripheral portion being attached to the outer peripheral portion of the base portion;

the rearward covering portion having an open configuration and a closed configuration;

wherein the rearward covering portion has an approximately flat geometry in the open configuration; the rearward covering portion including a rear portion and a first side portion;

the rearward covering portion including at least one preconfigured folding portion disposed between the rear portion and the first side portion;

the at least one preconfigured folding portion having a first permanent ridge and a second permanent ridge;

wherein the at least one preconfigured folding portion facilitates folding between the rear portion and the first side portion when the rearward covering portion moves from the open configuration to the closed configuration;

a tensioning member extending through a plurality of apertures within the upper periphery of the forward covering portion and also extending through a plurality of apertures within the rearward covering portion;

wherein the tensioning member extends through one of the plurality of apertures within the rearward covering portion positioned on the at least one preconfigured folding portion and through one of the plurality of apertures positioned on the first side portion, and the tensioning member further extends along an outward facing surface of the rearward covering portion and extends from an outward facing surface of the forward covering portion through an opening located in the lower periphery of the outward facing surface of the forward covering portion; and a tensioning device configured to control tension in the tensioning member.

13. The article of footwear according to claim 12, wherein the tensioning device is an automatic tensioning device.

14. The article of footwear according to claim 12, wherein the tensioning member has a first end portion and a second end portion; and wherein the tensioning device is attached to the first end portion and the second end portion of the tensioning member to control the tension in the tensioning member.

15. The article of footwear according to claim 14, wherein the tensioning device is disposed within the sole structure of the article of footwear.

16. The article of footwear according to claim 15, wherein the rearward covering portion further includes a second side portion; and wherein the first end portion extends from the first side portion to the tensioning device and the second end portion extends from the second side portion to the tensioning device.

17. The article of footwear according to claim 12, wherein the rearward covering portion folds at the second peripheral portion from an approximately horizontal position to an approximately vertical position.

18. The article of footwear according to claim 12, wherein the rearward covering portion is adjusted using the tensioning member that extends through the plurality of apertures in the rearward covering portion.

19. The article of footwear according to claim 1, wherein the rearward covering portion includes a rear portion, a first side portion, and at least one preconfigured folding portion disposed between the rear portion and the first side portion;

wherein the at least one preconfigured folding portion facilitates folding between the rear portion and the first side portion when the rearward covering portion moves from the open configuration to the closed configuration; and wherein a pair of apertures of the plurality of apertures within the rearward covering portion are disposed on opposing sides of the at least one preconfigured folding portion, and wherein the tensioning member extends through the pair of apertures.

20. The article of footwear according to claim 12, wherein a pair of apertures of the plurality of apertures within the rearward covering portion are disposed on opposing sides of the at least one preconfigured folding portion, and wherein the tensioning member extends through the pair of apertures.

* * * * *